United States Patent [19]

Anhalt et al.

[11] 4,037,911

[45] July 26, 1977

[54] ELECTRICAL CONNECTOR

[75] Inventors: John W. Anhalt, Orange; James H. Curley, Costa Mesa, both of Calif.

[73] Assignee: International Telephone and Telegraph Corporation, New York, N.Y.

[21] Appl. No.: 694,306

[22] Filed: June 9, 1976

[51] Int. Cl.[2] ..... H01R 9/16

[52] U.S. Cl. ..... 339/217 S

[58] Field of Search ..... 339/217 S

[56] References Cited

U.S. PATENT DOCUMENTS

| | | | |
|---|---|---|---|
| 2,468,368 | 4/1949 | Jackson | 339/217 S |
| 3,562,698 | 2/1971 | Merry | 339/217 S |
| 3,566,342 | 2/1971 | Schmitt | 339/217 S |
| 3,853,389 | 12/1974 | Ochipinti | 339/217 S |
| 3,866,997 | 2/1975 | Kreutter | 339/217 S |

*Primary Examiner*—Roy Lake

*Assistant Examiner*—Mark S. Bicks

*Attorney, Agent, or Firm*—Thomas L. Peterson

[57] ABSTRACT

An electrical connector in which a contact is mounted in a contact cavity in the connector insulator from the front and is removed forwardly from the cavity. The contact is formed with a forwardly and outwardly extending spring retention tine that engages a rearwardly facing shoulder in the cavity to prevent forward movement of the contact in the cavity. The tine embodies a relatively deformable area so that upon application of a predetermined forwardly directed force on the contact, the tine will fold back on itself at said deformable area, thereby allowing the tine to pass under the rearwardly facing shoulder in the cavity. Thus, the contact may be removed from the contact cavity without the use of a tool. The invention is particularly adaptable to contacts having wire-wrap tails which are accurately held in position by a stabilizing plate at the rear of the connector insulator.

13 Claims, 3 Drawing Figures

ELECTRICAL CONNECTOR

BACKGROUND OF THE INVENTION

The present invention relates to an electrical connector and, more particularly, to a contact retention assembly for an electrical connector and to a new contact for use in such an assembly.

The present invention is particularly concerned with the problems associated with removing stabilized wire-wrap terminals or contacts from insulators. However, as will be appreciated from the foregoing description, the invention is not limited to this specific application and may be applicable to a wide variety of electrical connectors.

Contacts having wire-wrap tails, when terminated by semi or fully automatic wire-wrapping machines, require close dimensional control or positioning. Such control is normally achieved by built-in restrictions or guides in the connector insulator. Retention of the contacts in the insulator is achieved by a barbed or press fit design which retains the contacts and also stabilizes them dimensionally. The major disadvantage of this approach is that when contacts are removed from the insulator for replacement, the nature of the retention degrades the contact cavities. This degredation results in loss of contact retention and subsequent contact failure due to push-out or dislodging during use of the connector.

In order to overcome this problem, it has been proposed to use a spring retention tine on the contact to releasably retain the contact within the insulator of an electrical connector. A connector utilizing such a contact is disclosed in U.S. Pat. No. 3,594,698 to Anhalt, assigned to the assignee of the present application. The connector disclosed in such patent is a zero insertion force connector. The spring retention tine of the contact is stamped from the body of the contact and bent outwardly and rearwardly of the body so that the tine will deflect inwardly when the contact is inserted into a contact cavity in an insulator from the rear of the insulator. After the tine passes a forwardly facing shoulder on the wall of the cavity, the tine springs outwardly to engage the shoulder and, thereby, restrict rearward movement of the contact in the cavity. The contact also embodies a forwardly facing shoulder behind the spring retention tine which engages a rearwardly facing shoulder in the contact cavity to restrict forward movement of the contact in the cavity. When using a contact having a wire-wrap tail, it is necessary to provide a stabilizing plate for the tail at the rear of the insulator. The stabilization of the wire-wrap tail is achieved by a slip fit between the tail and a hub on the stabilizing plate.

Occasionally a contact in a connector will be damaged due to wire-wrapping or improper handling of the connector. As a consequence, the contact must be removed and replaced. In order to remove the contact from the insulator in the proposed connector described above, a tool would have to be inserted into the contact cavity from the front of the insulator to deflect the spring retention tine out of engagement with the forwardly facing shoulder in the cavity. The contact would then be removed rearwardly from the cavity. However, prior to contact removal, the stabilizing plate must also be removed. If the connector utilizes a large number of contacts, it is extremely difficult to position the stabbilizing plate back over the contacts in the insulator due to the difficulty in aligning all the wire-wrap tails of the contacts with the holes in the stabilizing plate. Therefore, it would be desirable to employ a contact retention arrangement which allows the contacts to be inserted from the front of the insulator, and removed from the front so that the stabilizing plate need not be removed and reassembled onto the insulator in the event a damaged contact must be replaced. It is, therefore, the purpose of the present invention to provide a novel contact retention arrangement which allows front insertion and removal of a contact from a connector insulator.

SUMMARY OF THE INVENTION

According to the principal aspect of the present invention, there is provided an electrical connector in which a contact is mounted in a contact cavity of the connector insulator from the front and may be removed from the front of the insulator. The contact embodies a termination section which is formed with a spring retention tine that extends forwardly and outwardly from the body of the contact to engage a rearwardly facing shoulder in the contact cavity to restrict forward movement of the contact in the cavity. The tine embodies a relatively deformable area spaced from the end of the tine and the point of emergence of the tine from the contact body. When the contact is inserted into the contact cavity from the front of the insulator, the spring retention tine will deflect inwardly until the tine passes the shoulder in the cavity and, thereafter, the tine will spring outwardly behind the shoulder to restrict forward movement of the contact in the cavity. In order to remove the contact from the cavity, a predetermined forwardly directed force is applied to the contact so that the tine will fold back on itself at said deformable area and pass under the shoulder in the cavity. As a consequence, the contact may be removed from the contact cavity of the connector without the use of a special tool. If the contact embodies a wire-wrap tail which is accurately positioned by a stabilizing plate on the rear of the connector insulator, it will be appreciated that the contact may be removed from the connector for replacement without the requirement of removing the stabilizing plate. It will, of course, be appreciated that the contact retention arrangement of the present invention is applicable to connectors having contact terminations other than wire-wrap tails wherein it is desired to replace the contacts from the front of the connector insulator rather than from the rear, and without the requirement of a contact extraction tool.

DESCRIPTION OF THE PREFERRED EMBODIMENT

Figure 1:
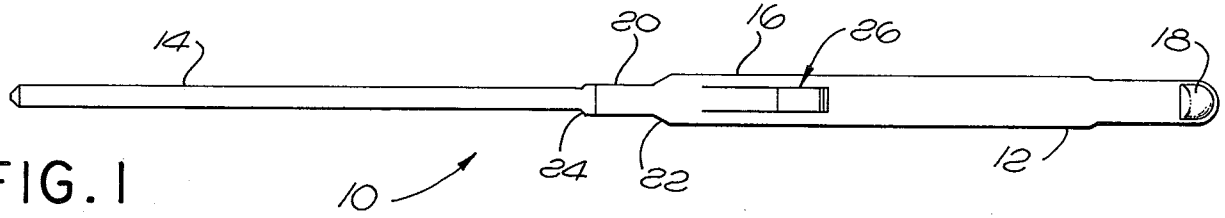
FIG. 1 is a top plan view of the novel contact of the present invention.
Figure 2:
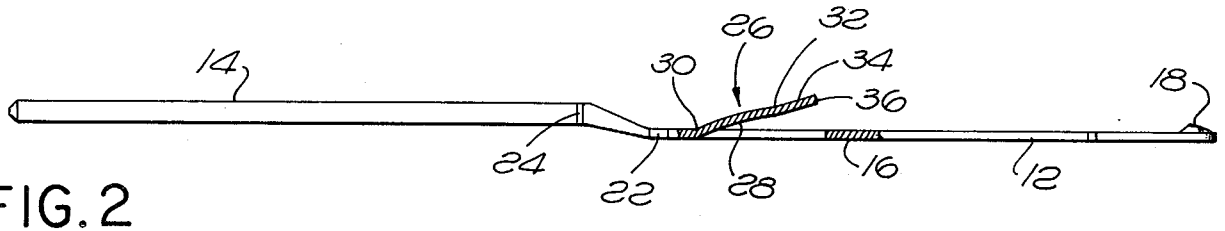
FIG. 2 is a side elevational view of the contact illustrated in FIG. 1, with the retention section of the contact shown in longitudinal section.

Reference is now made to FIGS. 1 and 2 of the drawings in detail, in which there is illustrated the novel contact of the present invention, generally designated 10. The contact is formed of an electrically conductive body and embodies a forward contacting section 12, a rear termination section 14, and an intermediate retention section 16. The forward contacting section is in the form of a flat spring blade having a contact protrusion 18 thereon. The contacting section of the contact 10 is particularly suited for use in a zero insertion force connector of the general type disclosed in the aforementioned Anhalt patent. The termination section 14 of the contact is in the form of a wire-wrap tail. A relatively narrow neck section 20 provides a transition between the wire-wrap tail 14 and the retention section 16 of the contact. A tapered transition area 22 between the neck section 20 and the wider retention section 16 of the contact provides a pair of rearwardly facing shoulders while a second tapered transition area 24 between the neck section 20 and the wire-wrap tail provides a second set of rearwardly facing shoulders. As best seen in FIG. 2, the forward contacting section 12 and the rear termination section 14 of the contact are laterally offset from each other and the neck section 20 of the contact extends at a slight acute angle to join the offset front and rear sections of the contact.

The intermediate retention section 16 of the contact embodies a spring retention tine, generally designated 26, which is stamped from the body of the contact and bent outwardly at an acute angle with respect to the contact body. It is noted that the tine extends in the forward direction, rather than rearwardly as do the retention tines disclosed in the aforementioned Anhalt patent. The tine includes an inner portion 28 which extends between the point of emergence 30 of the tine from the body of the contact and an intermediate area 32, and a outer portion 34 which extends from the area 32 to the end 36 of the tine. As seen in FIG. 2, the outer portion 34 of the tine is disposed at an acute angle relative to the body of the contact which is greater than the inner portion 28 of the tine. As a consequence, the intermediate area 32 between the inner portion 28 and an outer portion 34 of the tine forms a slight bend in the tine which extends transversely thereof. Such bend creates a relatively deformable area on the tine which allows the tine to fold back on itself at such area upon the application of a predetermined rearwardly directed force to the end 36 of the tine, which will be explained later.

Preferably, the inner portion 28 of the tine has a slight arcuate, convex configuration. The arcuate configuration of the inner portion 28 of the tine imparts greater strength and load carrying capacity to such portion so as to resist bending of the tine at the point 30 when such predetermined rearwardly directed force is applied to the end of the tine, thereby assuring that the tine will fold back on itself at the intermediate area 32. It will be appreciated that the deformable, foldable area 32 of the tine may be provided by other configurations than that discussed above. For example, the cross-section of the tine could be reduced at area 32 to provide a weakened or deformable region allowing the tine to fold back upon itself upon application of a rearwardly directed force to the end of the tine.

Figure 3:
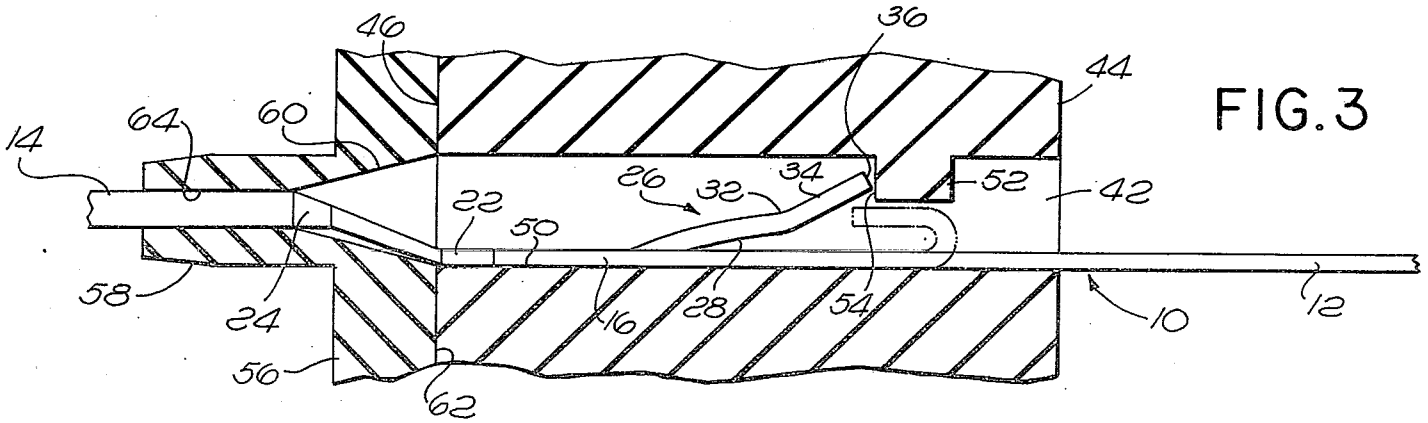
FIG. 3 is a fragmentary, sectional view through a connector insulator showing the contact of FIGS. 1 and 2 mounted in a contact cavity in the insulator.

Reference is now made to FIG. 3 of the drawing which illustrates a connector insulator 40 containing the contact 10. The insulator 40 has a contact cavity 42 which extends from the front face 44 of the insulator to the rear face 46 thereof. Preferably, the cavity has a rectangular cross-section providing a flat, upper side 48 and an opposed flat, lower side 50. A projection 52 extends downwardly from the upper side 48 of the cavity toward, but spaced from the lower side 50. The projection 52 is spaced rearwardly behind the front face 44 of the insulator. The projection defines a rearwardly facing shoulder 54 in the cavity.

A stabilizing insulator plate 56 is mounted on the rear face 46 of the insulator 40. The stabilizing plate embodies a rearwardly extending hollow hub 58 which is aligned with the center line of the contact cavity 42. The plate embodies a tapered bore 60 which extends from the front face 62 of the plate rearwardly and merges with the opening 64 in the hub 58.

The contact 10 is inserted into the cavity 42 from the front 44 of the insulator. As the retention tine 26 of the contact passes under the projection 42, it is deflected downwardly. As the tine passes rearwardly beyond the projection, the tine springs outwardly to the position illustrated in full lines in FIG. 3 wherein the end 36 of the tine engages, or is closely adjacent to, the rearwardly facing shoulder 54 on the projection, thereby restricting forward movement of the contact in the cavity. The flat retention and forward contacting sections 16 and 12, respectively, of the contact lie on the lower side 50 of the contact cavity. The wire-wrap tail 14 of the contact extends through the opening 64 of the hub 58 on the stabilizing plate. The hub serves to support the wire-wrap tail against lateral movement. The rearwardly facing shoulders defined by the tapered transition region 24 of the contact engage the wall of the tapered bore 60 to restrict rearward movement of the contact in the cavity 42. Thus, it is seen that the contact is restricted against forward and rearward longitudinal movement in the cavity 42, and the wire-wrap tail 14 is accurately located by the stabilizing plate 56 for wire-wrapping operations.

In order to remove the contact 10 from the cavity 42, in the event the contact is damaged during wire-wrapping or improper handling of the connector, a predetermined forwardly directed force is applied to the contact. Such force is the same as that previously mentioned herein which is required to fold that tine 26. The force should substantially exceed any forwardly directed forces on the contact which occur during wire-wrapping operations or result from normal handling of the connector and disengagement thereof from a mating connector member. Such force may be conveniently applied to the contact by pushing forwardly on the rear end of the wire-wrap tail 14. Due to the deformable area 32 on the retention line 26, the tine will fold back upon itself under the application of such forwardly directed force on the contact and will assume the configuration generally as shown in dotted lines in FIG. 3. Thus, the tine is caused to collapse and pass under the projection 52 in the contact cavity, thereby allowing the contact to be freely removed from the front of the cavity. It will be appreciated that contact removal is achieved without the need of using a special contact extraction tool or the requirement of removing the stabilizing plate 56. The removed contact is not reusable. However, this is not a drawback since wire-wrap contacts do not need to be removed unless they have been damaged.

As stated previously herein, the invention is not limited to a contact having a wire-wrap tail. If another form of contact termination is employed, the stabilizing plate 56 may be eliminated. In this event, rearward movement of the contact in the cavity 42 could be restricted by forming a forwardly facing shoulder in the contact cavity 42 adjacent to the rear face 46 of the insulator, which would be engaged by the shoulder 22 on the contact. Alternatively, a rearwardly facing shoulder may be formed on the contact body in front of and spaced from the end of the retention tine 26 which would engage the front of the projection 52 in the cavity. Other modifications and variations within the scope of the invention will be apparent to those skilled in the art.

What is claimed is:

1. An electrical contact adapted to be mounted in a contact cavity in an insulator of an electrical connector comprising:

an electrically conductive body having a forward contacting section and a retention section behind said contacting section;

a spring retention tine on said retention section extending forwardly and outwardly therefrom so that the end thereof may engage a rearwardly facing shoulder in said cavity; and said tine embodying a relatively deformable area spaced from said end and the point of emergence of said tine from said body whereby, upon the application of a predetermined rearwardly directed force to said end of said tine, said tine will fold back on itself at said deformable area.

2. An electrical contact as set forth in claim 1 wherein:

said deformable area is defined by a bend in said tine extending transversely of the tine.

3. An electrical contact as set forth in claim 1 wherein:

said tine has a first portion between said point and said deformable area, and a second portion between said deformable area and said end; and said first portion is disposed at an acute angle relative to the longitudinal axis of said body and said second portion is disposed at an acute angle relative to said axis greater than said first portion.

4. An electrical contact as set forth in claim 3 wherein:

said first portion has an arcuate, convex configuration in the longitudinal direction of said body.

5. An electrical contact as set forth in claim 1 including:

means on said body behind said tine defining a rearwardly facing shoulder.

6. An electrical contact as set forth in claim 1 including:

a wire-wrap tail behind said retention section.

7. An electrical connector comprising:

an insulator having a front face and a rear face with a contact cavity therein extending from said front face to said rear face;

a projection extending inwardly into said cavity from one side thereof toward the opposite side defining a space therebetween and a rearwardly facing shoulder;

an electrical contact mounted in said cavity, said contact comprising an electrically conductive body having a forward contacting section adjacent to said forward face, a rear termination section, and an intermediate retention section;

a spring retention tine on said intermediate retention section extending forwardly and outwardly therefrom, the end of said tine engaging said shoulder to restrict forward movement of said contact in said cavity; and said tine embodying a relatively deformable area spaced from said end and the point of emergence of said tine from said body whereby, upon the application of a predetermined forwardly directed force to said contact, said tine will fold back on itself at said deformable area and pass under said projection.

8. An electrical connector as set forth in claim 7 wherein:

said deformable area is defined by a bend in said tine extending transversely of the tine.

9. An electrical connector as set forth in claim 7 wherein:

said tine has a first portion between said point and said deformable area, and a second portion between said deformable area and said end; and said first portion is disposed at an acute angle relative to the longitudinal axis of said body and said second portion is disposed at an acute angle relative to said axis greater than said first portion.

10. An electrical connector as set forth in claim 7 including:

means on said body behind said tine defining a rearwardly facing shoulder; and a forwardly facing shoulder in said cavity engaging said shoulder on said contact for restricting rearward movement of said contact in said cavity.

11. An electrical connector as set forth in claim 7 wherein:

said rear termination section comprises a wire-wrap tail;

a stabilizing plate is positioned against said rear face of said insulator; and said stabilizing plate having a bore aligned with said cavity and a hollow rearwardly extending hub aligned with said bore defining an elongated opening, said tail being slidably mounted in said opening and supported against lateral movement by said hub.

12. An electrical connector as set forth in claim 11 including:

a forwardly facing shoulder in said opening; and a rearwardly facing shoulder on said contact engaging said shoulder in said opening for restricting rearward movement of said contact in said cavity.

13. A method of removing a contact from a contact cavity in an electrical connector insulator wherein said contact embodies a spring retention tine extending forwardly and outwardly from the body of said contact and engages at its end a rearwardly facing shoulder in said cavity, and with said tine embodying a relatively deformable area spaced from said end and the point of emergence of said tine from said body, comprising the steps of:

applying sufficient forwardly directed force to said contact to cause said tine to fold back on itself at said deformable area; and continuing the application of a forwardly directed force on said contact until said folded tine passes under said shoulder and said contact is removed from said cavity.

* * * * *